US008430241B1

(12) United States Patent
Balogh

(10) Patent No.: US 8,430,241 B1
(45) **Date of Patent: *Apr. 30, 2013**

(54) HAIR-APPLIANCE HOLDER

(75) Inventor: Erin Balogh, San Marcos, CA (US)

(73) Assignee: Gobalo, LLC, San Marcos, CA (US)

( * ) Notice: Subject to any disclaimer, the term of this patent is extended or adjusted under 35 U.S.C. 154(b) by 11 days.

This patent is subject to a terminal disclaimer.

(21) Appl. No.: 13/089,236

(22) Filed: Apr. 18, 2011

Related U.S. Application Data

(63) Continuation-in-part of application No. 12/623,740, filed on Nov. 23, 2009.

(51) Int. Cl.
*A45C 11/26* (2006.01)

(52) U.S. Cl.
USPC ..... 206/349; 297/188.15; 206/581

(58) Field of Classification Search ..... 206/235, 206/581, 349, 387.15; 297/188.18
See application file for complete search history.

(56) References Cited

U.S. PATENT DOCUMENTS

| | | | | |
|---|---|---|---|---|
| 4,570,792 | A * | 2/1986 | Conway | 206/349 |
| 4,871,074 | A * | 10/1989 | Bryson et al. | 211/26 |
| 5,562,209 | A * | 10/1996 | Jackson et al. | 206/349 |
| 6,068,122 | A * | 5/2000 | Burns et al. | 206/372 |
| 7,284,791 | B1 * | 10/2007 | Wright | 297/188.18 |
| 7,337,902 | B2 * | 3/2008 | Rosdal et al. | 206/349 |
| 2004/0255421 | A1 * | 12/2004 | Kim | 15/244.3 |
| 2007/0050951 | A1 * | 3/2007 | Simmons | 24/7 |
| 2009/0173648 | A1 * | 7/2009 | Geneva | 206/320 |
| 2009/0190865 | A1 * | 7/2009 | Chang | 383/110 |

OTHER PUBLICATIONS

Author: WWW.FOLICA.COM; Title of the article: LuXor Universal Double Stand Tool Holder; Title of the item: http://www.folica.com/LuXor_Universal_d1314.html; Date: Product review at least as early as Sep. 12, 2004; pp. 1 & 2; Publisher: www.folica.com; City and/or country: World Wide—Internet.

Author: WWW.FOLICA.COM; Title of the article: Rsession Tools Heat Proof Mat; Title of the item: http://www.folica.com/Rsession_Tools_d6361.html; Date: unknown; p. 1; Publisher: www.folica.com; City and/or country: World Wide—Internet.

(Continued)

*Primary Examiner* — J. Gregory Pickett
*Assistant Examiner* — Raven Collins
(74) *Attorney, Agent, or Firm* — Howard Russell

(57) ABSTRACT

A hair-appliance holder for retaining a hair-styling appliance, such as a hot hair iron, a hair dryer or the like, in hanging relationship from an upper edge portion of a pedestal sink basin, or alternatively from a countertop or a towel rod, and which, while retaining the hair appliance, reduces the likelihood of burning contact by the appliance with adjacent objects and a user thereof, the hair-appliance holder comprising a strap member, or other retaining means such as a counterweight, a sticky silicone underside to the strap member, or one or more suction cups on the underside of the strap member for attaching to a counter top, adjacent a countertop edge, or a sink basin, and a preferably heat-resistant retaining member attached to the strap member and having at least one open end for inserting a hair-styling appliance, each named member preferably being made of semi-rigid silicone.

2 Claims, 10 Drawing Sheets

OTHER PUBLICATIONS

Author: WWW.FOLICA.COM; Title of the article: Amika Heat Proof Styler Holder; Title of the item: http://www.folica.com/Amika_Heat_Proo_d4981.htmll; Date: Nov. 7, 2009 pp. 1 & 2; Publisher: www.folica.com; City and/or country: World Wide—Internet.

Author: HTTP://HOTTYHOODY.COM; Title of the article: Hotty Hoody—Cool Sleeve; Title of the item: http://hottyhoody.com; Date: Copyright date on web page: 2006; p. 1; Publisher: http://hottyhoody.com/; City and/or country: World Wide—Internet.

Author: WWW.BAGGALLINI.COM; Title of the article: Baggallini Fashion Totes, Handbags and Luggage Product Overview; Title of the item: http://www.baggallini.com/product1.asp?collection='jca' &product='CIC221'; Date: Copyright date on web page: 2009; p. 1; Publisher: www.baggallini.com; City and/or country: World Wide—Internet.

* cited by examiner

HAIR-APPLIANCE HOLDER

This application is a continuation-in-part of U.S. patent application Ser. No. 12/623,740, filed Nov. 23, 2009, for Hair-Appliance Holder and claims the benefit of that application.

BACKGROUND OF THE INVENTION

The present invention relates in general to a portable receptacle for use in and on a pedestal sink and in particular to a heat-resistant sheath, preferably made of silicone, for storing electric heated hair-styling appliances such as curling irons, straightening irons, flattening irons, heated rollers, hot brushes, hot air curlers, and stylers such as hair dryers and the like.

There are a number and variety of electric heated hair-styling appliances, including without limitation curling irons, straightening or flattening irons, heated rollers, hot brushes, and hot-air curlers and stylers. To use most of these devices, the appliance must be plugged into an outlet and allowed to warm up. After use, the unplugged appliance can take up to fifteen minutes to cool to a safe handling and storage temperature.

Many of these appliances are operated in small or cluttered bathrooms and at times when the user of the appliance is in a rush. Particularly for users of these appliances whose bathrooms are designed with a free-standing pedestal sink, there is no counter space or unoccupied surface on which to rest the appliance while it warms up or cools off. This situation creates a risk of injury to the user or other individuals, as well as increasing the risk of damage to property.

Hair dryers and curling irons account for many residential fires every year, resulting in deaths, injuries, and millions of dollars in property loss. Further, there are very many hair care appliance related injuries reported every year. To date, there has not been available a simple means of safely storing a hot hair appliance, immediately before, during and after use thereof, and especially in small and/or cluttered bathrooms with simply a pedestal sink or a towel bar, without the increased risk of storing the hair appliance at such times in exposed fashion with hot surfaces of the appliance being closely adjacent combustible material or the humans that use the appliance.

SUMMARY OF THE INVENTION

In accordance with a first aspect of the present invention, a hair-appliance holder for retaining a hot hair-styling appliance, such as a hot hair iron, on an upper, horizontal ledge, or edge, portion near the top of a pedestal sink basin and which, while retaining the hot hair-styling appliance, reduces the likelihood of burning contact by the iron with adjacent objects and a user thereof, is provided. The hair-appliance holder in accordance with the first aspect of the present invention comprises a counterweight member, a heat-resistant retaining member, pouch, pocket, envelope or sheath, having at least one open end for inserting a hot hair-styling appliance, and a strap member having a first end and a second end, the first end of the strap member being connected to the counterweight member, and the second end of the strap member being connected to the heat-resistant retaining member.

While, preferably the elements of the hair-appliance holder, and especially the retaining member, are constructed of silicone, or other flexible, heat-resistant material that is waterproof and provides a non-slip, gripping, surface for stable mounting on the bathroom sink, any heat resistant material with similar characteristics may be used. It is also contemplated that the strap and/or the counterweight means may be suitably replaced by a wire or other hooking component that transverses the edge of the sink basin, gripping the upper portion of the sink basin, and interconnecting with the retaining member.

In one embodiment of the invention, the heat-resistant retaining member is suspended from the upper, horizontal ledge, or top edge, of a sink basin, balanced by the counterweight member (or hooking member) placed within the sink basin near the top edge. The heat-resistant retaining member is partially enclosed, as at one end of a sheath or sleeve portion of the retaining member, and preferably made of semi-rigid silicone, with the sleeve or sheath opening preferably facing upwardly and remaining open and accessible to placement of the hair-appliance by the user. Preferably, at least one hole is advantageously formed in the bottom portion of the retaining member to allow the passage out of the retaining member of any water that may incidentally or accidentally fall into the retaining member. This helps prevent contact of an electrical hair appliance with water and the attendant electrocution hazard such would present.

In accordance with an alternate embodiment of this first aspect of the invention, a hair-appliance holder is provided that is adapted for retaining a hair-styling appliance relative to a countertop having an edge and while reducing the likelihood of contact by the hair appliance with the countertop, other objects and a user thereof. The hair-appliance holder in accordance with this embodiment comprises: retaining means adapted for retaining the hair appliance holder and any appliance therein relative to the countertop; and a retaining member having at least one open end adapted for inserting a hair-styling appliance, the open end connected to the retaining means, the retaining means being adapted for engaging the countertop to provide sufficient retention of said hair-appliance holder relative to the countertop.

Preferably, the retaining means of this embodiment of the invention comprises a strap member preferably made of silicone and having first and second ends and upper and lower surfaces, the lower surface being for engaging the countertop. Further, the retaining member comprises at least one open end adapted for inserting a hair-styling appliance, the open end being connected to the second end of the strap member, the first end of the strap member being adapted for laying upon the countertop at a sufficient distance from the second end of the strap member to provide sufficient counter weight and friction between the lower surface and the countertop to retain the hair-appliance holder and any appliance therein hanging relative to and from the edge and the countertop.

Still further, the retaining member of this embodiment of the invention preferably comprises a partial enclosure comprising a heat-resistant sleeve having a first end and a second end, the sleeve being enclosed at the first end and open at the second end, the sleeve being attached to, or preferably formed integrally with, the second end of the strap member at the second end of the sleeve. Preferably the second end of the sleeve is made of semi-rigid but flexible silicone so as to remain open ready to receive the hair-styling appliance.

Further in accordance with this embodiment of the invention, preferably, the underside of the strap member of the hair-appliance holder further comprises a sticky portion to aid retention of the hair-appliance holder hanging from and relative to the edge and the countertop. The strap member is preferably of sufficient size to allow resting of the hair appliance thereon without touching of the hair appliance to the countertop.

The hair-appliance holder of the present invention allows for safe and convenient placement of a hot hair appliance in the heat-resistant receptacle during and after use of the hot hair appliance. Those familiar with the uses and risks of electric hair-styling appliances will appreciate the greater degree of safety offered by having a convenient, versatile receptacle, usable in many kinds of bathrooms and regardless of limited counter space, for storing heated hair-styling devices while the appliances are warming up, between uses, or cooling down. With a hair-appliance holder, such as a hair-iron holder, available, a user of an electric heated hair-styling appliance will be able to safely deposit the heated appliance in the heat-resistant sheath as long as reasonably necessary during the course of normal use.

The hair-appliance holder, with retaining member and any counterweight, is easily user-installed, without drilling, screwing, affixing, or adhering, etc., by placing the connecting strap member (or hooking member) over the top edge of a sink basin or laying it on a countertop. The counterweight member of the first embodiment of the first aspect of the invention is preferably constructed of a metal bar, sand or other relatively heavy item, enclosed in silicone, as by sewing or molding, or attached or otherwise adhered to the silicone, retained in a pocket or otherwise secured with the silicone around the counterweight member. It will be appreciated by those of ordinary skill in the art that any suitable counterweight material may be used if it is of sufficient weight to perform the intended function.

To install the hair-appliance holder in accordance with the first embodiment of this aspect of the invention, the user simply places the counterweight of the hair-appliance holder in the sink basin, near the top horizontal edge, suspending the heat-resistant silicone sheath conveniently over the edge of the sink in front of the user or on either side of a typical sink basin. To install the hair-appliance holder in accordance with the second embodiment of the this aspect of the invention, the retaining means, preferably a strap member, may be laid upon the countertop with the retaining member hanging over the edge of the countertop, or with the retaining member hanging over any other edge surface, such as a cupboard, a drawer, or on the front of a sink and countertop arrangement.

In accordance with a third embodiment of this aspect of the invention, there is provided a hair-appliance holder for retaining a hair-styling appliance relative to a countertop structure having an edge and while reducing the likelihood of contact by the appliance with the countertop, other objects and a user of the hair appliance, the hair-appliance holder comprising: an engagement member adapted for engaging the countertop structure near the edge thereof; and a retaining member interconnected with the engagement member and having at least one open end adapted for inserting a hair-styling appliance, the retaining member and the interconnected engagement member being retained in hanging relationship relative to the edge of the countertop.

Preferably, the engagement member in accordance with this embodiment of the invention comprises at least one suction cup member, but preferably a plurality of suction cup members, attached to the engagement member. The suction cup members attached to the engagement member serve to attach the retaining member, which is in turn interconnected with the engagement member, to the counter top, on the front of the counter, or otherwise adjacent the upper edge of the counter. Further, the suction cups may be used to attach the retaining member, via the engagement member, to the surface of the sink.

Preferably the retaining member comprises a partial enclosure comprising a heat-resistant sleeve made of silicone and having a first end and a second end, the sleeve being enclosed at the first end and open at the second end, the sleeve being attached to the engagement member adjacent the second end of the sleeve. As with other embodiments of this aspect of the invention, the retaining member in accordance with this aspect of the invention preferably further comprises a lower end having formed therein a hole for allowing liquid having accidentally fallen within the retaining member to pass out of the retaining member to prevent electrocution hazard upon placing a hot hair styling appliance in the retaining member.

In accordance with another aspect of the invention, there is provided a hair-appliance holder for retaining a hair-styling appliance on a towel rod and adapted for reducing the likelihood of burning contact by the hair-styling appliance with adjacent objects and a user thereof, the hair-appliance holder comprising: a retaining member having at least one open end for receiving a hair appliance; and attachment means attached to the retaining member and adapted for retaining said hair appliance holder and any appliance therein relative to the towel rod. The retaining member may comprise a partial enclosure comprising a sleeve having a first end and a second end, the sleeve being enclosed at the first end and open at the second end.

In accordance with this aspect of the invention, the attachment means preferably comprises a strap member having first and second ends, and the first end of the strap member that is opposite the appliance retaining means, sleeve or receptacle forms a looped attachment member for wrapping around the towel bar and attaching back on the strap, as with the use of buttons, snaps, or a hook and loop, as with Velcro Brand, attachment mechanism. Alternatively, the first end of the looped attachment member is adapted for passing over the towel rod in looped fashion to be positioned adjacent the second end of the looped attachment member, the first and second ends being adapted for hanging on the towel rod below the towel rod, the second end of the looped attachment member being connected to the retaining member. The attachment means in accordance with this alternative embodiment of this aspect of the invention further comprises a silicone, rubber or other elastic, pliable and friction-fit type bracelet member adapted for constricting the looped attachment member intermediate of the towel rod and the adjacent first and second ends of the looped attachment member for retaining the looped attachment member relative to the towel rod.

Still further, alternatively, the attachment means of this aspect of the invention comprises a hook attached to the retaining member, the hook being adapted for hanging the hair-appliance holder from the towel rod.

These embodiments of this aspect of the invention offer a greater range of options in adapting the use of the hair-appliance holder to various settings where there is a towel bar or rack available. Thus, in the alternative embodiment of the present invention, the counterweight is replaced by a looped attachment member with attachment means, with the strap member being placed, or looped, over a towel bar.

As with the other embodiments of the invention, the hair-appliance holder of this aspect of the invention, including the retaining member thereof, is made of heat-resistant silicone.

In accordance with another alternative embodiment of the invention, there is provided a hair-appliance holder that is suitable for either mounting on a pedestal sink, or cupboard, or a towel rack or bar. This embodiment is provided with both a counterweight and an attachment mechanism, it being the case that the counterweight may in a preferred embodiment, be removed as may be desirable to hang this embodiment of the invention from a towel rack.

In accordance with another aspect of the invention, it will also be appreciated that the hair-appliance holder of the invention is preferably made of semi-rigid silicone that is flexible enough to be easily folded, stored, or packed for travel. This flexible material selection also allows for easy packaging and storage on a home-appliance shelf of a store for selling such items. As for storing the hair-appliance holder after use, a user may place a warm hair iron in the sheath, for placement in a drawer or baggage, as long as he/she takes sufficient care not to allow contact of the iron with a combustible material or a material or surface that may be damaged by the heat. If in doubt, the user must exercise caution in not placing the hair iron in the sheath for storage in any way that would allow damage to other property.

Users of heated hair-appliances who use the hair-appliance holder on the edge of a bathroom sink, countertop or the alternative hair-appliance holder adapted for a towel bar, will be able to easily remove the accessory when no longer in use, and it will not conflict with or be an obstacle to ordinary use of the sink or towel bar. The hair-appliance holder also removes completely, without leaving marks or causing damage to the surface underneath. Upon removal of the hair-appliance holder from packaging at a store, comprising the attachment means and heat-resistant retaining member, the user is capable of installing the hair-appliance holder in a safe and convenient manner without using any tools.

The present invention addresses the safety concerns involved with operation and handling of heated hair appliances. Risk of damage to property by contact with a hot hair iron, for instance, is resolved by providing an enclosed, heat-resistant receptacle, rather than requiring ample counter space clear of other potentially ignitable items. By reducing exposure of the heated appliance, the risk of injury to the user or other person is also lessened.

In accordance with another aspect of the present invention there is provided a heat-resistant, easily installable, hair-appliance holder that is adaptable for various models of bathroom sinks. In accordance with this aspect of the invention, the strap member connecting the counterweight to the heat-resistant retaining member is of sufficient length, or varying widths, to accommodate varying widths of sink edges. This can also be adapted, in the alternative embodiment of the present invention, to be fastened around a towel bar by replacing the counterweight with a looped attachment member. This makes the hair-appliance holder a versatile bathroom accessory easily installable in a number of different settings.

In a preferred embodiment of the invention, the counterweight and strap members make contact with the basin and top edge of a standard pedestal sink, with the heat-resistant retaining member suspended stably in front of or on the side of the sink. Alternatively, the strap member is long enough to provide the counterweight and friction necessary, and even suction cups may be used, to secure the appliance holder on a countertop with the appliance holder pouch or sleeve hanging over the edge of the front of the countertop. Still further, alternatively, the strap member makes contact with a standard towel bar, with the counterweight replaced by a looped attachment member with further attachment means, and the heat-resistant retaining member is suspended securely from the towel bar. In either embodiment, or a third embodiment allowing both counterweight installation or looped attachment means installation, the heat-resistant retaining member is securely in place and readily accessible to receive heated hair-styling appliances placed therein by the user.

The subject matter of the present invention is particularly pointed out and distinctly claimed in the concluding portion of this specification. However, both the organization and method of operation, together with further advantages and objects thereof, may best be understood by reference to the following descriptions taken in connection with accompanying drawings wherein like reference characters refer to like elements.

DETAILED DESCRIPTION

Figure 1:
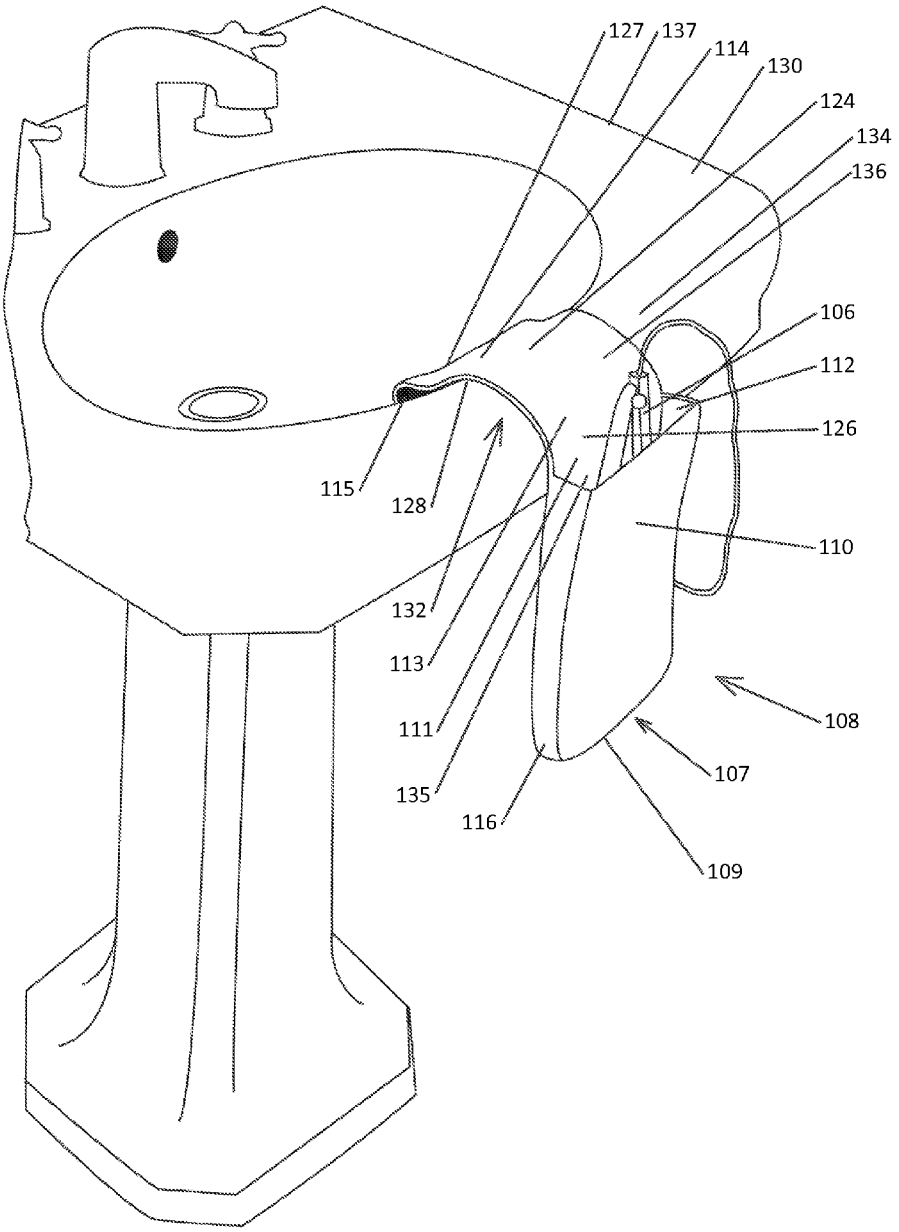
FIG. 1 is a front left perspective view of a hair-appliance holder in accordance with a preferred embodiment of the present invention and shown on a standard pedestal sink.
Figure 2:
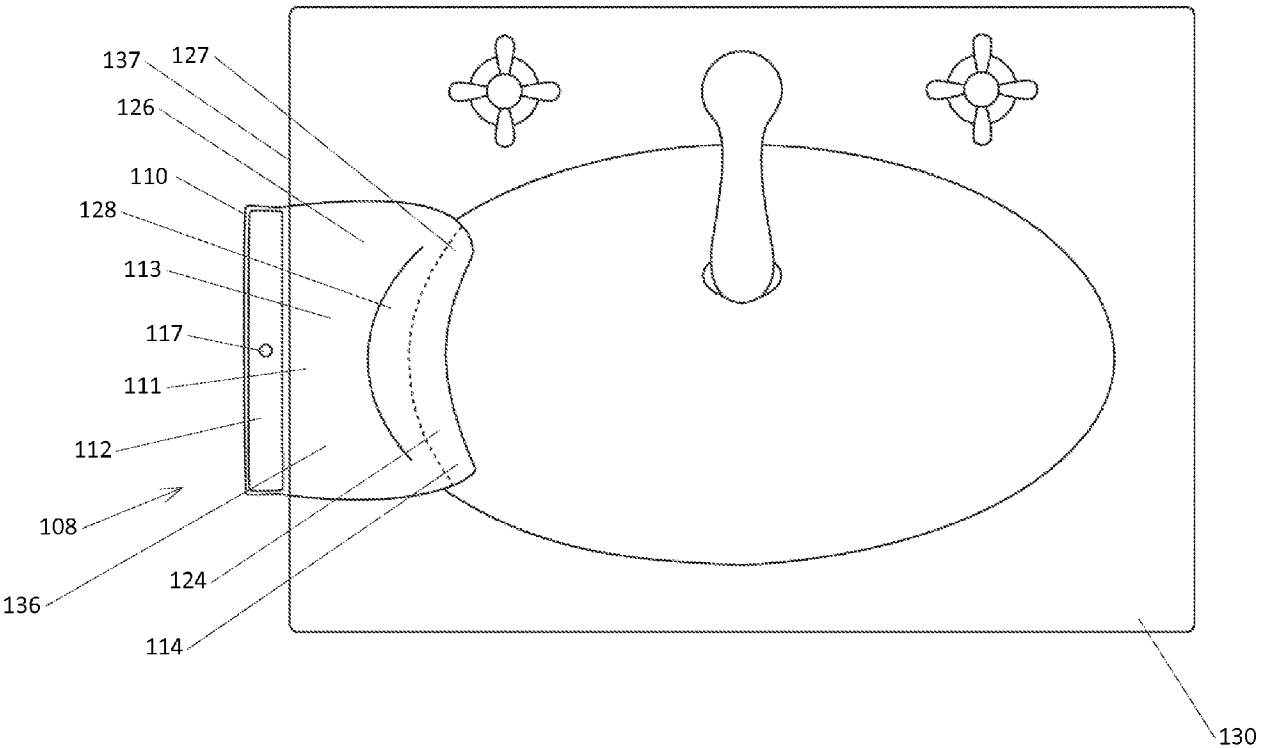
FIG. 2 is a top plan view of a hair-appliance holder in accordance with a preferred embodiment of the present invention and shown installed on a standard pedestal sink.

Referring to FIGS. 1 and 2, a hair-appliance holder 108 according to the present invention comprises a vertically hanging and partially enclosed heat-resistant retaining member, pouch, sleeve, sheath, or envelope 110 that is preferably and approximately 4-8 inches wide by 6-9 inches long by 1-2.5 inches deep, or other suitable size for a corresponding hair-appliance, and though made preferably of heat-resistant, semi-rigid silicone, may be constructed of any of a number of heat-resistant materials known in the art and possessing properties suitable for the purposes and functions of the invention.

An opening 112 on the top of this pouch 110 is generally rectangular in shape, though due to the flexible nature of the silicone material the opening 112 may be more oval in shape when in use according to its design, having a hot hair-styling appliance 6, or other hair-appliance such as a hair dryer, placed within the retaining member 110 by the user. A bottom portion 109 of the retaining member 110 is closed, and the closed bottom corners 116 may be rounded in shape in accordance with standard methods for sealing the silicone retaining member. Preferably, at least one hole 107 is advantageously formed in the bottom portion 109 of the retaining member 110 to allow the passage out of the retaining member of any water that may incidentally or accidentally fall into the retaining member. This helps prevent electrocution hazard relating to bringing an electrical hair appliance into contact with water. Users are cautioned never to place an electrical hair appliance in contact with water as electrocution, serious injury or death may result. A top portion 111 of the retaining member 10 is connected to a strap member 113, which is preferably rectangular in shape and has a first end 124 and a second end 126.

The strap member 113 is also preferably made of heat-resistant, semi-rigid silicone, approximately ¼-inch in thickness. The strap member 113 is connected at the second end 126 thereof to the top portion 111 of the retaining member 110 and at the first end 124 thereof to a silicon portion 127 of counterweight member 114. The counterweight member 114 attached on the first end 124 of the strap member 113, consists of heat-resistant, semi-rigid silicone encasing 127, or otherwise enveloping or attached to, an inner metal or other weight 115 made of steel, pot metal, sand or other suitable relatively heavy material. One method this encasement may be accomplished is by the semi-rigid silicone 127 of the counterweight member 114 being at its farthest end 128 wrapped around, folded over or molded around the cylindrical inner weight 115, or other shaped weight, and sealed, as by stitching, gluing, attaching, buttoning, encasing, or the like, at the point at which the edge of the farthest portion of the first end 128 of the silicone portion 127 wraps around the weight 115 and makes contact with an underside surface 132 of the silicone material of the connecting strap member 113. The inner weight 115 is cylindrical in shape in one embodiment, but may be just as easy rectangular or a plurality of rectangular or cylindrical shapes, and is of sufficient mass to balance the weight of the retaining member 110, as well as the weight of the hair-styling appliance 106 stored within, as suspended by the strap member 113 over the top front edge 134, or side edge 137 as shown in FIG. 2, of a standard pedestal sink.

In the preferred embodiment of the present invention the strap member 113 is made of a material, such as silicone, that has sufficient gripping, suction or adhesion properties on one surface, this surface being the underside surface 132 of the strap member 113 contiguous with the back, or inner, retaining member pouch wall 135, such that when this surface is placed over the top front edge 134 or side edge 137 of a standard pedestal sink 130, the counterweight member 114 at the one end is situated in the basin of the sink 130 and the heat-resistant retaining member 110 is suspended in front of the sink, or preferably on either side of the sink, with the opening 112 clearly open, visible and accessible to the user located in front of and facing toward the pedestal sink. It will be appreciated that the hair-appliance holder 108 may be installed on either side of, or in front of, sink 130 without departing from the scope of the invention.

It will be appreciated that the gripping surface 132 on the underside of the strap member 113, (668 and 668' in FIGS. 6 and 7) serves to provide traction with the surface on which the hair-appliance holder 108 is mounted, such as the top front edge 134, or side edge 137, of a standard pedestal sink, thereby suspending the retaining member 110 in a stable manner, balanced by the mass of the counterweight member 114. Also, the upper surface 136 of the strap member 113 has gripping, friction or adhesive type properties to allow relatively easy placement of the hair appliance thereon, without slipping, for example during brushing of the user's hair.

Figure 4:
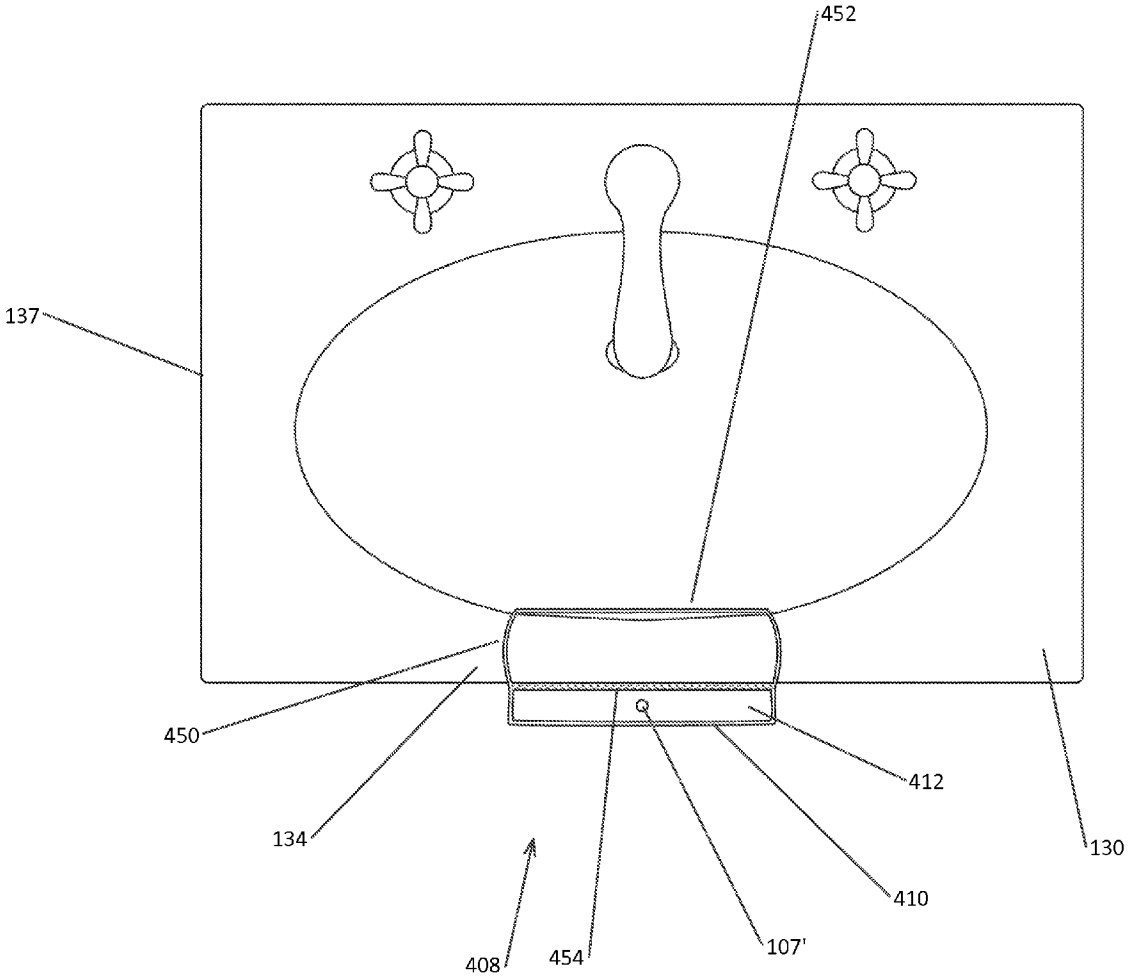
FIG. 4 is a top plan view of a hair-appliance holder in accordance with an alternate embodiment of the present invention and shown installed on a standard pedestal sink.

Looking at FIG. 4, an alternative embodiment of the invention is shown wherein a wire frame member 450 (preferably rubber coated), hook 452 and support 454 are employed (without strap 113 or counterweight 114) with support 454 passing through the upper back portion 111 (FIG. 1) of retaining member 410 to hold the retaining member in alternative fashion to the side 137, or front 134, edge of sink 130. It will be appreciated that with this alternative embodiment of the invention, as well as the primary and even the other embodiments of the invention, may be installed in varying locations within a room, such as on a cupboard, on the sink, on a towel rack, on the drawer or other ledge.

Figure 6:
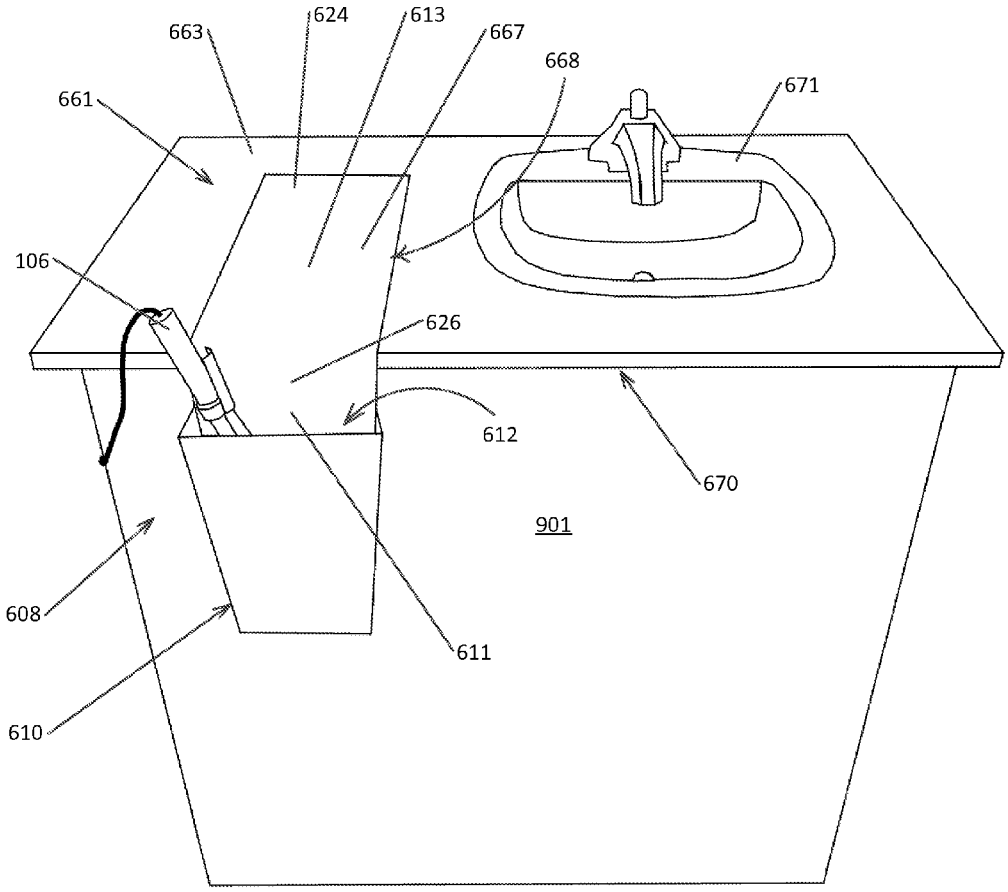
FIG. 6 is an front perspective view of a hair-appliance holder having a hair iron therein and in accordance with an embodiment of the invention shown installed on a countertop adjacent a sink basin inset in the countertop.
Figure 7:
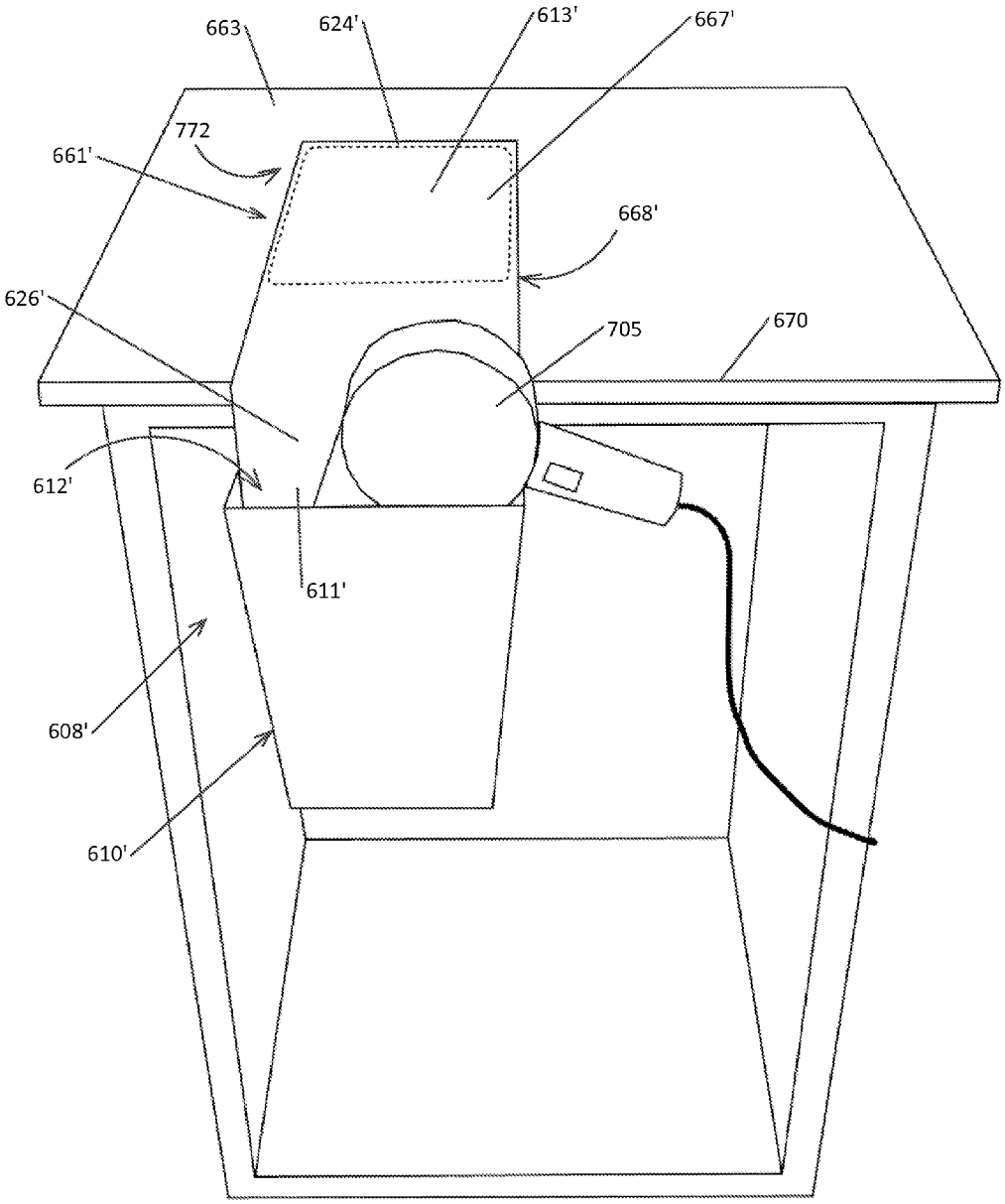
FIG. 7 is a front perspective view of a hair-appliance holder having a hair dryer therein and in accordance with an embodiment of the invention shown installed on a countertop.

Referring now to FIGS. 6 and 7, respectively, another embodiment of a hair-appliance holder 608, 608' (respectively) in accordance with the present invention is shown comprising attachment or retaining means 661, 661' adapted for retaining the hair appliance holder and any hair appliance 106, 705 therein relative to the countertop 663. Preferably, the retaining means 661, 661' of this embodiment of the invention comprises a strap member 613, 613' preferably made of silicone and having a first end 624, 624', a second end 626, 626', an upper surface 667, 667' and a lower surface 668, 668' the lower surface being adapted for engaging the countertop 663 in that it is made of a material that grips the countertop and thus resists slippage of the now hanging hair-appliance holder 608, 608' relative to the surface of the countertop, the edge 670 of the countertop and the sink basin 671 (FIG. 6).

The hair-appliance holder 608, 608' further comprises a hair appliance retaining member 610, 610', such as a partially enclosed, preferably heat-resistant pouch or sleeve 610, 610' having at least one open end 612, 612' adapted for inserting a hair-styling appliance 106, 705, the open end of the sleeve being connected to the retaining means 661, 661'. The open end 612, 612' of the hair appliance retaining member 610, 610' is attached to the second end 626, 626' of strap member 613, 613' and is preferably formed integrally with the strap member and made out of heat-resistant, semi-rigid, but flexible silicone so as to remain open ready to receive the hair-styling appliance 106, 705. The retaining means 661, 661' is adapted for engaging the countertop 663 to provide sufficient retention of the hair-appliance holder 608, 608' relative to the countertop.

Open end 612, 612' is connected to the second end 626, 626' of the strap member 613, 613', the first end 624, 624' of the strap member being adapted for laying upon the countertop 663 at a sufficient distance from the second end of the strap member to provide sufficient counter weight and friction between the lower surface 668, 668' of the strap member and the countertop to retain the hair-appliance holder and any hair appliance therein hanging relative to and from the edge 670 and the countertop.

As shown in FIG. 7, further in accordance with this embodiment of the invention, preferably, the underside 668' of the strap member 613' of the hair-appliance holder 608' further comprises a sticky portion 772 to aid retention of the hair-appliance holder 608' hanging from and relative to the edge 670 and the countertop 663. The sticky portion 772 may comprise a sticky gel pad or other tacky surface that is fixed to the underside 668' of the strap member 613' as with glue or other attachment means.

The strap member 613, 613' is preferably of sufficient size, such as 6 inches wide by 18 inches long, to allow resting of the hair iron 106, or hair dryer 705, thereon without touching of the hair appliance to the countertop 663. This not only serves to prevent the hair appliance, in the case of the hot hair iron 106, from burning the countertop, but also prevents falling of the hair iron or hair dryer 705 onto the ground, or undue shifting of the appliance, to avoid breakage or other damage or injury such as burns to the user. It will be appreciated by those of ordinary skill in the art that varying combinations of sizes of strap members and stickiness of the underside sticky portion 772 (or surface area thereof) of the strap member 613, 613' may be used to adequately hold the pouch 610, 610' and hair appliance 106, 705 in position relative to the countertop 663.

In a preferred embodiment of the present invention the strap member 613, 613' is made of a material, such as silicone, that has sufficient gripping, suction or adhesion properties on one surface, this surface being the underside surface 668, 668' of the strap member contiguous with the back, or inner, retaining member pouch wall 611, 611' such that when this surface is placed over the edge 670 or side edge of a countertop 663 or cupboard, the counterweighting strap 613, 613' is situated on the countertop a sufficient distance from the (front) edge 670 and the pouch member 610, 610' suspended in front of the countertop, or on either side of the countertop, with the opening 612, 612' clearly open, visible and accessible to the user located in front of and facing toward the countertop. Further, as with other embodiments of the invention, the pouch 610, 610' preferably has a hole, such as hole 107' in FIG. 4, therein to allow passage of water or other liquid out of the pouch in the event such is accidentally leaked into the pouch.

Figure 8:
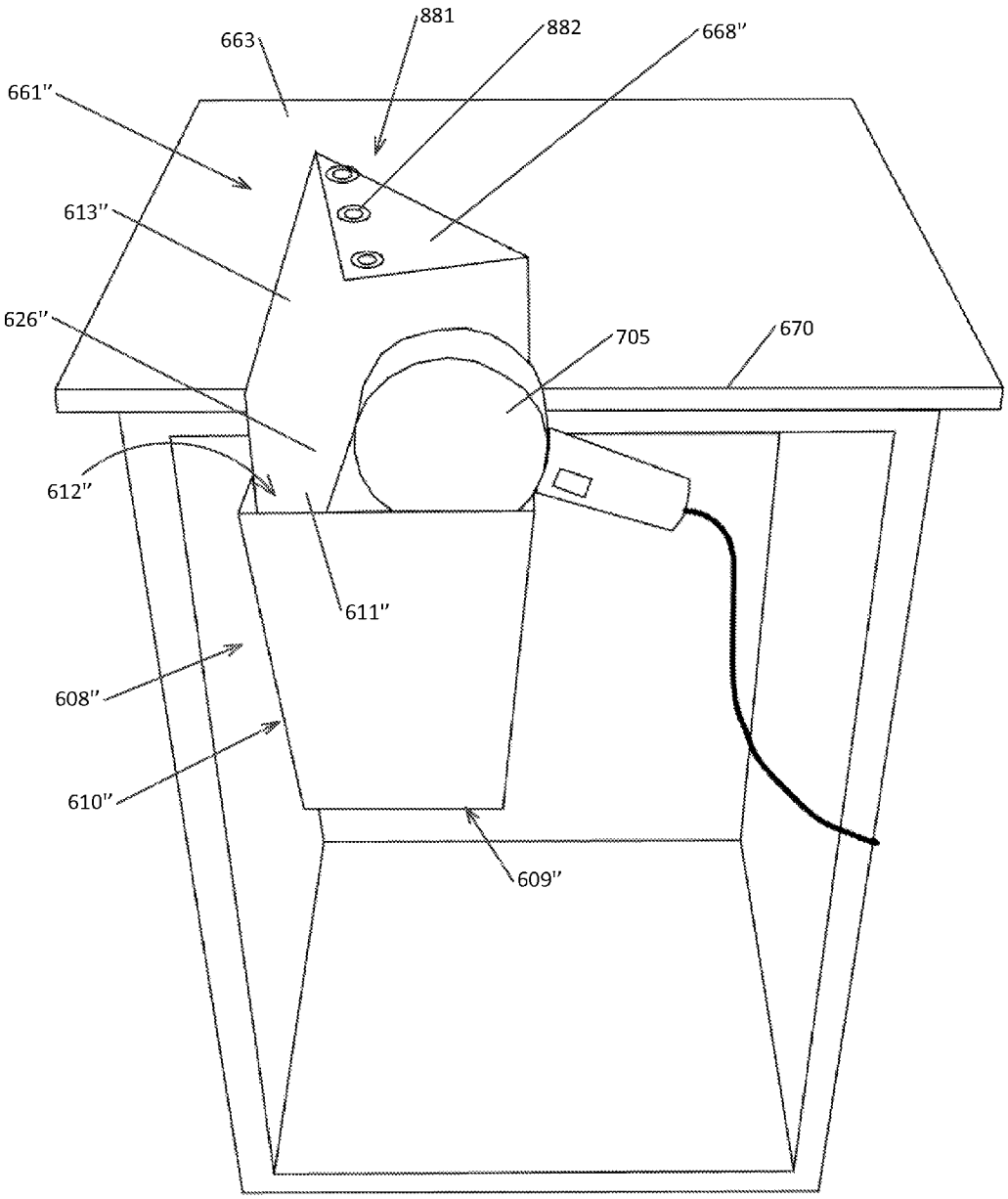
FIG. 8 is a front perspective view of a hair appliance holder having a hair dryer therein and in accordance with an embodiment of the invention shown installed and held in place on a countertop with the use of suction cup means.

Referring to FIG. 8, in another alternative embodiment of the invention, a hair-appliance holder 608" for retaining a hair-styling appliance 705 relative to a countertop 663 structure having an edge 670 and while reducing the likelihood of contact by the appliance with the countertop, other objects and a user of the hair appliance, comprises an engagement member 881 adapted for engaging the countertop structure on the surface 663 thereof or near the edge 670 thereof. Like other embodiments of the invention, this embodiment further comprises a retaining member 610" interconnected with the engagement member 881 and having at least one open end 612"adapted for inserting a hair-styling appliance 705. As with other embodiments of the invention, the retaining member 610" (preferably made of silicone) and the interconnected engagement member 881 are retained in hanging relationship relative to the edge 670 of the countertop 663. Preferably the engagement member 881 comprises one or more suction cup members 882 attached to the underside 668" of the engagement member. Further, the retaining member 610" of this embodiment of the invention may comprise a partial enclosure comprising a heat-resistant sleeve 610" that may be open at both ends or open at the second (upper) end 611' and closed at the first (lower) end 609". The sleeve 610" is attached to a second end 626" of the engagement member 881 adjacent the second end 611" of the sleeve.

Alternatively, in the case of a closed first (lower) end 609" of sleeve 610", as with other embodiments of the invention, this embodiment of the invention further comprises a hole (not shown), such as hole 107' shown in FIG. 4, for allowing liquid having accidentally fallen within the retaining member sleeve 610" to pass out of the retaining member sleeve to prevent electrocution hazard upon placing a hair styling appliance 705 in the retaining member sleeve.

Figure 9:
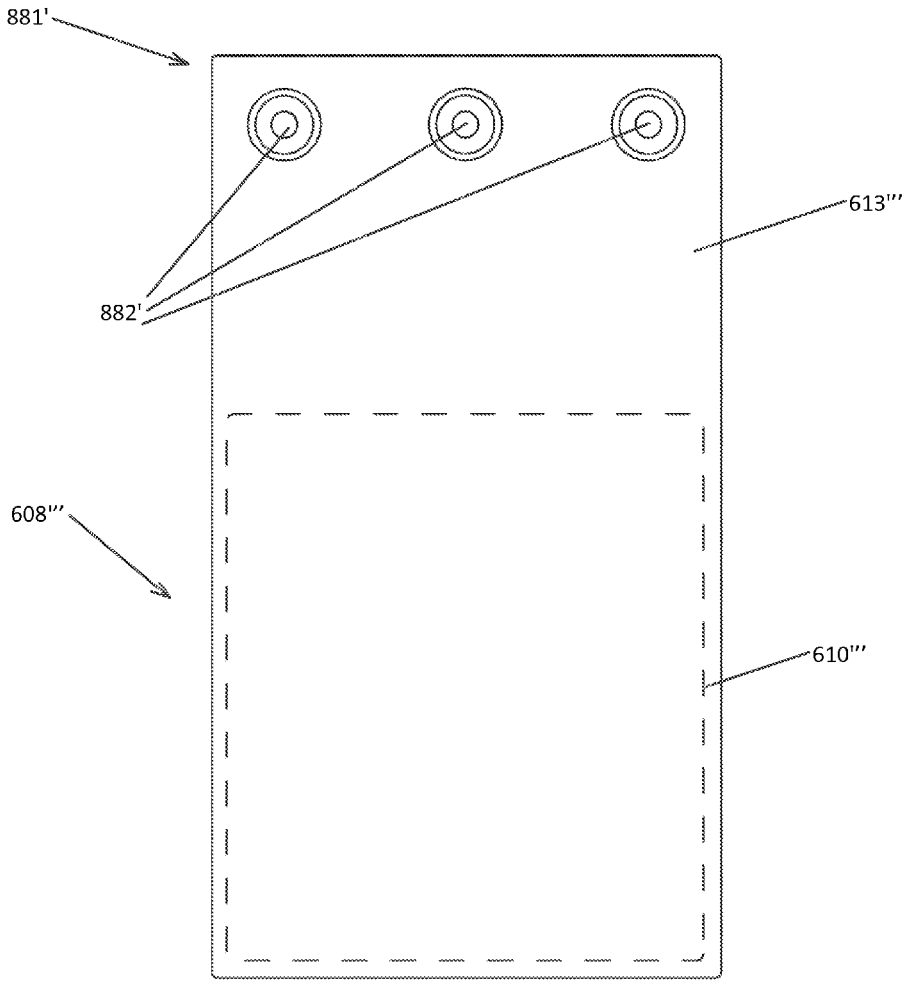
FIG. 9 is a rear plan view of a hair appliance holder in accordance with an embodiment of the invention having attachment and retention means comprising suction cups.

Referring to FIG. 9, there is provided yet another alternate embodiment of the hair-appliance holder 608'" in accordance with the present invention wherein the engagement member 881' comprises attached thereto, as with rivets or other attachment means known in the art, at least one, but preferably a plurality of, suction cups 882'. The difference between hair-appliance holder 608' and hair-appliance holder 608" is that the strap 613'" on hair-appliance holder 608' is shorter, allowing for attachment of the hair-appliance holder, via the engagement member 881', to the front of a cabinet, near the edge of the upper surface of the cabinet (e.g., to the front of cabinet 901 on FIG. 6), such that the user may still easily reach the retaining member or pocket 610' to place a hair-appliance in it.

This feature of the invention, namely suction cups 882, 882', allows for releasable, but otherwise secure, attachment of the hair-appliance holder 608", 608'" on a counter, cupboard or other structure.

Figure 3:
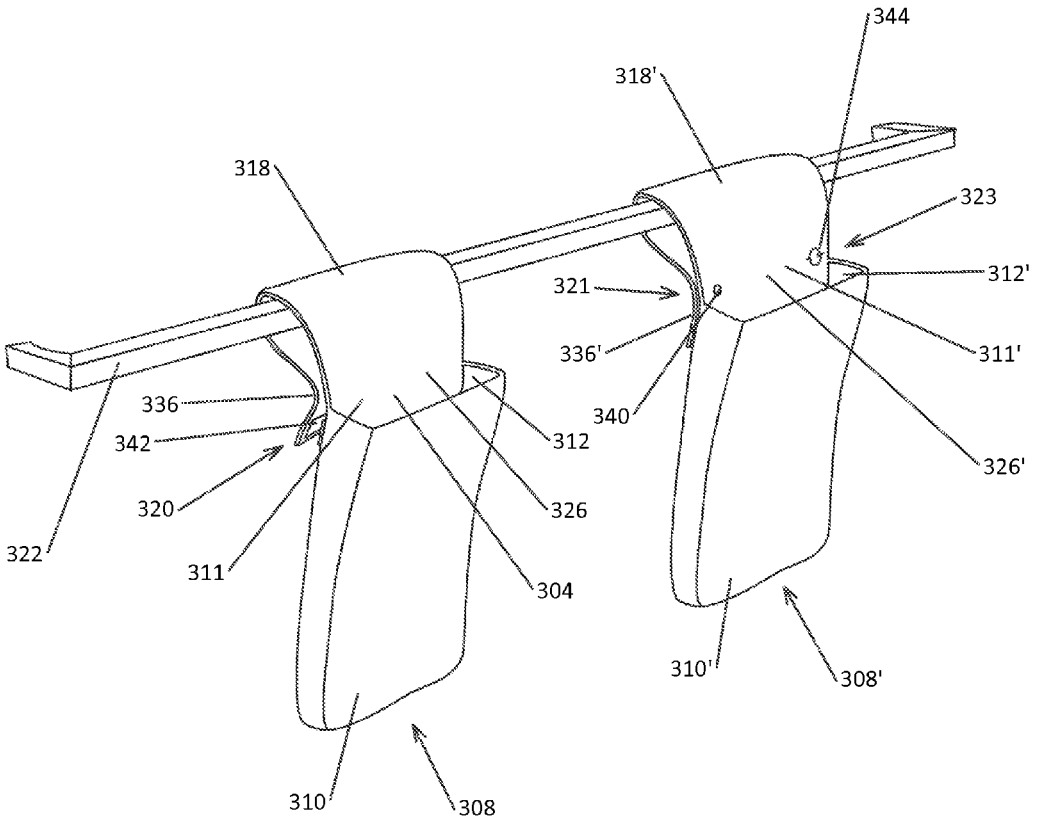
FIG. 3 is a front left perspective view of two hair-appliance holders, each in accordance with an alternate embodiment of the present invention, and each showing different means of attachment to a towel bar.

Referring now to FIG. 3, in another alternative embodiment of the hair-appliance holder 308, 308' (viewing FIG. 3 from left to right, respectively) of the present invention, there is no counterweight member 114 or inner weight 115. Instead, a looped attachment member 318, 318' further comprises one or more of attachment means, such as hook and loop (Velcro Brand) attachment means 320, snap-button fastener combination 321, or button and button-hole combination 323. These various attachment and fastener means are well known in other art fields. By way of example, snap-button fastener combination 321 comprises a seat portion thereof 340 (partially not shown) attached to a second end 326' of the looped attachment member 318' and a button portion thereof (not shown) attached to a first end 336' of the looped attachment member. Thus, upon snapping the snap-button fastener combination 321 together, the looped attachment member 318, 318', that has been looped around the towel bar 322 in order to hang the hair-appliance holder 308, 308' from the towel bar with the retaining member 310, 310' hanging below the towel bar, is attached at either end thereof around the towel bar, with the second end 326, 326' (that is attached to and preferably integral with upper top portion 311, 311' of retaining member 310, 310') of the looped attachment member being attached to its first end 336, 336', respectively.

This feature in the alternative embodiment allows for releasable connection of the first end 336, 336' and second ends 326, 326' of the looped attachment member 318, 318' around a towel rod 322, or other bar, for example, by releasably engaging the button portion of the snap-button fastener combination 340 that is riveted (or otherwise attached) to the looped attachment member 318', with the seat portion of the snap-button fastener combination 340 that is also riveted (or otherwise attached) to the second end 326' of the looped attachment member 318'. Or alternatively this may be accomplished by attaching the loop hook combination fastener 320 or the button and button-hole combination fastener 323 in similar fashion. As installed, the looped attachment member 318, 318' is placed over the towel rod 322 such that the retaining member opening 312, 312' is open and clearly visible and accessible to the user located in front of and facing toward the towel rod 322.

Figure 10:
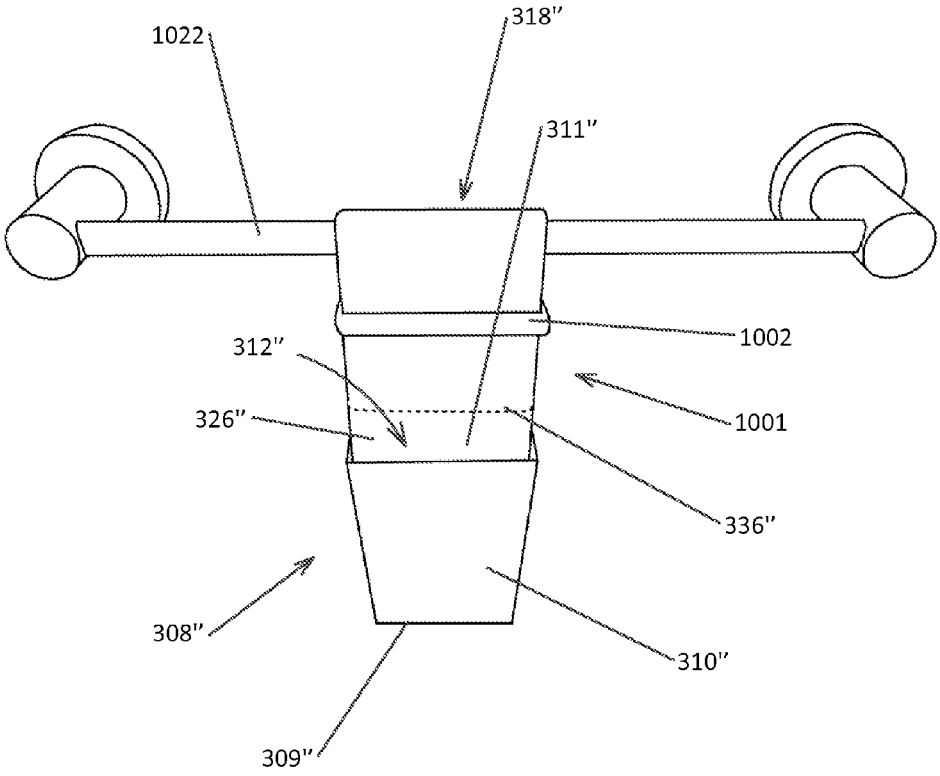
FIG. 10 is a front perspective view of a hair-appliance holder in accordance with an embodiment of the invention and comprising retention means of an elastic bracelet-type constricting band for holding the ends of the strap member looped over a towel rod.

Referring now to FIG. 10, a hair-appliance holder 308" for retaining a hair-styling appliance (not shown) on a towel rod 1022 and adapted for reducing the likelihood of burning contact by the hair-styling appliance with adjacent objects and a user thereof, comprises: a retaining member 310" having at least one open end 312" for receiving a hair appliance. Thus, like all other embodiments of the invention, the retaining member 310" of the hair-appliance holder 308" comprises a partial enclosure comprising a sleeve 310" having a first, or bottom, end 309" and a second, or top, end 311", the sleeve preferably being enclosed at the first end and open at the second end with a hole 107 (not shown) therein to allow escape of any liquids that might fall into the device.

The hair-appliance holder 308" further comprises attachment means 1001 attached to the retaining member 310" and adapted for retaining the hair appliance holder and any appliance therein relative to the towel rod 1022.

Preferably, the attachment means 1001 of the hair-appliance holder 308" of this embodiment of the invention comprises a looped attachment member 318" having a first end 336" and a second end 326", the first end of the looped attachment member being adapted for passing over the towel rod 1022 in looped fashion to be positioned adjacent the second end of the looped attachment member. Thus, the first end 336" and the second end 326" of the looped attachment member 318" is adapted for hanging from the towel rod 1022 below the towel rod. The second end 326" of the looped attachment member 318" is connected to the retaining member 310" or is preferably formed integrally out of silicone with the top (upper back) portion 311" of the retaining member. The attachment member 318" further comprises a bracelet member 1002 adapted for constricting the looped attachment member 318" intermediate of the towel rod 1022 and the adjacent first and second ends (first end 336" and second end 326") of the looped attachment member for retaining the looped attachment member relative to the towel rod.

The retaining member sleeve 310" is attached to the second end 326" of the looped attachment member 318" adjacent the second end 311" of the sleeve. Like other embodiments of the invention, the retaining member 310" and the looped attachment member 318" are preferably made of silicone.

It will be appreciated by those of ordinary skill in the art that other means of fixing the looped attachment member 318" on the towel rod 1022 may be employed, such as standard hook and loop (Velcro Brand) attachment means 542, 543 (FIG. 5), by standard button and hole means 344 (FIG. 3), a rigid hook attached to a silicone-lined cup, or other well-known attachment means.

As installed, in any embodiment of the present invention, the heat-resistant retaining member, preferably being composed of semi-rigid silicone, remains open and accessible as a receptacle for hair-styling appliances, such as a hot hair iron or hair dryer, as an alternative to setting such hair-styling appliances on a counter or other surface.

It will also be appreciated by those of ordinary skill in the art that the design of the hair-appliance holder is versatile, being adapted for installation and use in connection with a large variety of sink types, or many kinds of towel bars, ledges, countertops or cupboards without departing from the scope and spirit of the present invention. There is also no need for the use of tools or other equipment to perform additional installation procedures, such as drilling, screwing, affixing, or adhering. Since the process of installation is uncomplicated, the process of removal can likewise be appreciated by those of ordinary skill in the art.

Figure 5:
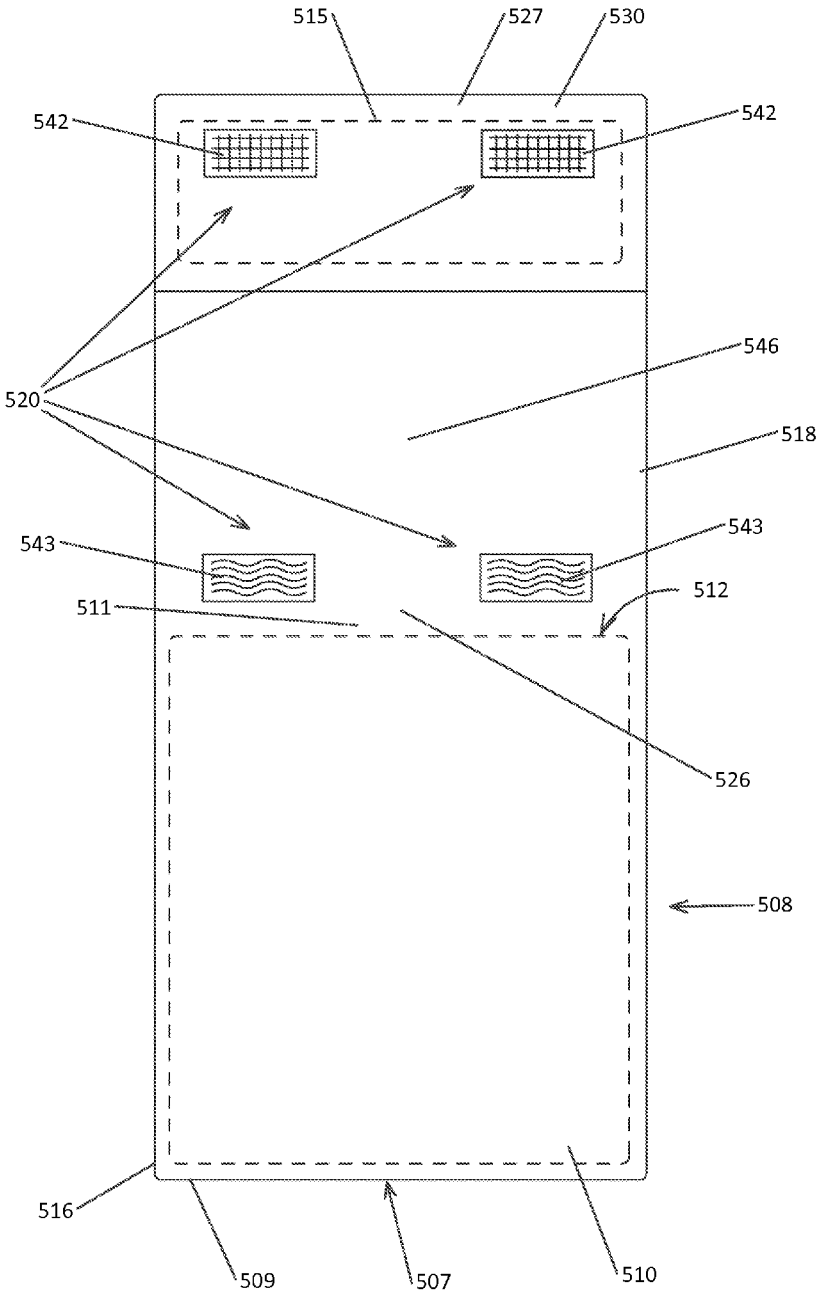
FIG. 5 is a top plan view of a back portion of an alternative embodiment of the present invention and showing both a removable counterweight for installation of the hair-appliance holder on a pedestal or other sink, and attachment means for alternate attachment to a towel or other bar.

Referring now to FIG. 5, there is shown the back side of yet another alternative embodiment of a hair-appliance holder 508 according to the present invention comprising a partially enclosed heat-resistant retaining member, pouch, sleeve, sheath, or envelope 510 that is preferably and approximately 6-9 inches wide by 10 inches long by 1-2.5 inches deep, or other suitable size for a given hair-appliance, and made of similar materials to the preferred embodiment.

An opening 512 on the top of the retaining member 510 is generally rectangular in shape, though due to the flexible nature of the silicone material, the opening 512 may be more oval in shape when in use with a hot hair-styling appliance (not shown in FIG. 5) placed within the retaining member 510 by the user. A bottom portion 509 of the retaining member 510 is closed, and the closed bottom corners 516 of the hair appliance holder may be rounded in shape in accordance with standard methods for sealing the silicone retaining member. Preferably, at least one hole 507 is advantageously formed in the bottom portion 509 of the retaining member 510, to allow the passage out of the retaining member of any liquid that may incidentally fall into the retaining member in order to help prevent electrocution hazard. A top portion 511 of the retaining member 510 is connected to a strap/looped attachment member 546, which is preferably rectangular in shape and has a first end 527 and a second end 526.

The strap/looped attachment member 546 is also preferably made of heat-resistant, semi-rigid silicone, approximately ¼-inch in thickness. The strap/looped attachment member 546 is connected at the second end 526 thereof to the top portion 511 of the retaining member 510 and at the first end 527 thereof to an envelope portion 530, or other attachment means for holding counterweight 515. The envelope portion 530 consists of heat-resistant, semi-rigid silicone and encases, or otherwise envelopes, or is attached to, counterweight 515. Counterweight 515 may be made of steel, pot metal, sand or other suitable relatively heavy material. Counterweight 515 is cylindrical in shape and is of sufficient mass to counterbalance the weight of the retaining member 510, as well as the weight of the hair-styling appliance stored within, as suspended by the strap/looped attachment member 546 over the top front edge 134, or side edge 137, of a standard pedestal sink 130.

Still in accordance with the hair-appliance holder 508 of this alternative embodiment of the present invention, as seen in FIG. 5, the counterweight 515 is preferably easily removable and may be removed, or selectively not removed at the discretion of the user from the envelope portion 530, and the strap/looped attachment member 546 further comprises attachment means 520, such as a loop and hook fastener combination having a loop portion 542 thereof attached to a first end 527 of the strap/looped attachment member 546 and a hook portion 543 thereof attached to a second end 526 of the strap/looped attachment member 546. The strap/looped attachment member 546 is attached at its second end 526 to the top portion 511 of the retaining member 510.

This feature in the alternative embodiment allows for alternate releasable connection of the first end 527 and the second end 526 of the strap/looped attachment member 546, around a towel rod by releasably engaging the loop portion 542 of, for example, the loop and hook fastener combination with the hook portion 543 of the loop and hook fastener combination. As installed, the strap/looped attachment member 546 is placed over the towel rod such that the retaining member opening 512 is open and clearly visible and accessible to the user located in front of and facing toward the towel rod.

It will be appreciated by those of ordinary skill in the art that other means of fixing the strap/looped attachment member 546 on a towel rod may be employed, such as standard snap-button fastener combination, by standard button and hole means, or other well-known attachment means.

With this alternate embodiment of the invention, it will be appreciated that flexibility is achieved in that a user may use the counterweight portion in certain instances, such as to install the invention on a pedestal sink, cupboard, etc., or he/she may remove the counterweight, or alternatively leave it in place, and install the invention on a towel bar using the loop and hook, or snap-button, fastener means.

Preferably, the hair-appliance holder, when no longer in use, is uninstalled by removing the counterweight member from the basin of the sink (or alternatively removing it from the countertop or detaching the looped attachment member from the towel bar), and lifting the attached strap member and retaining member to relocate the hair-appliance holder to the desired storage area. In the alternative embodiments of the invention, as in FIGS. 3, 5 and 10, the attachment means 320, 321, 323 of the hair-appliance holder 308, 308', 508, and 308"

(respectively) is releasably engaged and the looped attachment member 318 is lifted over the towel bar. Preferably being composed of semi-rigid silicone, the hair-appliance holder is foldable, allowing for a wide range of storage options as well as the possibility to pack the hair-appliance holder for travel. This flexibility feature also allows for compact storage of the hair-appliance holder in a box or other compact packaging for shipping and display on a store shelf. Regarding packing of the hair-appliance holder in baggage, or storing of it in a drawer or other enclosure, caution should be used to ensure that combustible material, or any surface that may be damaged by contact with a hot iron, is not allowed to come into contact with the iron despite its being stored in the silicone retaining member.

While a preferred embodiment and several alternative embodiments of the present invention have been shown and described, it will be apparent to those skilled in the art that many changes and modifications may be made without departing from the invention in its broader aspects. For example, it will be appreciated that there are other locations in which the hair-appliance holder can be mounted, such as a shower-curtain rod instead of a towel rod (in an alternative embodiment), or over the edge of a sink built into a counter as opposed to a pedestal sink (in the preferred embodiment). Further, it will be appreciated that other sizes of pouches, straps and counterweights may be employed, and using different materials having similar heat resistant, flexibility, gripping and waterproof characteristics to the preferred semi-rigid silicone, all without departing from the scope and spirit of the invention. The appended claims are therefore intended to cover all such changes and modifications as fall within the true spirit and scope of the invention.

What is claimed is:

1. A hair-appliance holder adapted for retaining a hot hair-styling appliance relative to and suspended hanging from and over an upper edge portion of a sink basin having a concave inner surface, or from a countertop, the hair-appliance holder reducing the likelihood of contact by the hair appliance with the countertop, other objects and a user thereof, said hair-appliance holder comprising:

an entirely silicone strap member having first and second ends, an upper surface and an underside surface, the underside surface comprising an outer non-slip waterproof surface portion having sufficient gripping, suction or adhesion properties on its surface to provide traction with the concave inner surface of the sink basin or countertop and the upper surface comprising an outer non-slip waterproof heat-resistant and burn-resistant surface adapted for non-slip support of the hot hair appliance when the user sets the hair-appliance down on the strap during use;

an entirely silicone, partially enclosed retaining member adapted for hanging from an upper edge of the sink basin or countertop and comprising first and second ends, said retaining member being closed at the first end thereof, the second end of said silicone retaining member comprising an open end adapted for inserting receiving the hair-appliance, the second end of said silicone retaining member being semi-rigid but flexible so as to remain open adapted to receive the hot hair-styling appliance during repeated insertion and removal during use of the hot hair-styling appliance from said retaining member, said retaining member being contiguous and integral with said silicone strap member, said silicone strap member having a first end and a second end, said second end of said strap member connected adjacent to the open end of said retaining member, said strap member being of sufficient size and weight such that, together with the non-slip gripping of said strap member along the underside of said strap member, said strap member providing sufficient counterweight and friction between the lower surface of said strap member, and the gripping contact along the underside surface portion of said strap member along and with the concave inner surface of the sink basin or countertop such that said strap member is adapted to retain the hair-appliance holder with the retaining member suspended hanging from and over the edge of the countertop when the hair appliance is in said retaining member.

2. The hair-appliance holder of claim 1, wherein the first end of said retaining member comprises at least one hole formed in the first end of the retaining member, the hole being adapted for allowing liquid to pass out of the retaining member during use hanging from the sink basin or countertop.

* * * * *